US006590172B1

(12) United States Patent
Gadre et al.

(10) Patent No.: US 6,590,172 B1
(45) Date of Patent: Jul. 8, 2003

(54) CIRCUIT BREAKER MECHANISM FOR A ROTARY CONTACT SYSTEM

(75) Inventors: Aniruddha Dattatraya Gadre, Niskayuna, NY (US); Hemant Kumar Mody, Avon, CT (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 10/063,217

(22) Filed: Mar. 29, 2002

(51) Int. Cl.[7] ..... H01H 79/00

(52) U.S. Cl. ..... 200/244; 200/288; 335/16; 335/46; 335/193; 218/22; 218/32

(58) Field of Search ..... 200/244, 288; 335/16, 46, 193; 218/22, 30, 31, 32

(56) References Cited

U.S. PATENT DOCUMENTS 4,255,732 A * 3/1981 Wafer et al. ..... 335/16
5,023,583 A * 6/1991 Bratkowski et al. ..... 335/195
5,089,795 A 2/1992 Morgan et al. ..... 335/46
5,117,211 A * 5/1992 Morgan et al. ..... 335/202
5,266,760 A * 11/1993 Link et al. ..... 200/244
5,793,270 A * 8/1998 Beck et al. ..... 335/16
6,246,021 B1 * 6/2001 Thilker et al. ..... 200/288
6,281,459 B1 * 8/2001 Munsch et al. ..... 218/22
6,369,340 B1 * 4/2002 Castonguay et al. ..... 200/244

* cited by examiner

*Primary Examiner*—Michael Friedhofer
(74) *Attorney, Agent, or Firm*—Paul J. DiConza; Patrick K. Patnode

(57) ABSTRACT

A circuit breaker is provided wherein the circuit breaker comprises a contact arm movable between a closed position, an open position and a blown open position wherein the contact arm is disposed in the circuit breaker. A bumper disposed to contact the contact arm when the contact arm is in the blown open position. In addition, a stop member disposed to be in contact with a linkage assembly so as to create a gap between the bumper and the contact arm when the contact arm is disposed in the open position.

15 Claims, 6 Drawing Sheets

CIRCUIT BREAKER MECHANISM FOR A ROTARY CONTACT SYSTEM

BACKGROUND OF INVENTION

The present invention relates generally to circuit breakers, and more particularly to multipole rotary contact circuit breakers having a stop mechanism arrangement.

Typical circuit breakers are overcurrent protective devices used for circuit protection and isolation. The basic function of a circuit breaker is to provide electrical system protection whenever an electrical abnormality occurs in any part of the system. In a rotary contact circuit breaker, current enters the system from a power line. The current passes through a load strap to a stationary contact fixed on the strap and then to a movable contact. The movable contact is fixedly attached to a contact arm, and the contact arm is typically secured to a rotor that in turn is rotatably mounted in an electrically insulative cassette. As long as the fixed contacts are in physical contact with the movable contacts (this position defined as the CLOSED position), the current passes from the fixed contacts to the movable contacts and out of the circuit breaker to downline electrical devices.

Rotary contact circuit breakers are typically stored and shipped in the OPEN position. The OPEN position refers to the position of the contacts in which the stationary contacts and the movable contacts are not in direct physical contact with each other. In addition, the OPEN position allows the contact arms to be in physical contact with rebound bumpers. These rebound bumpers serve to absorb the impact energy of the contact arm when the contact arm moves independently of the rotor upon introduction of a high current in the circuit breaker (also know as the BLOWN OPEN position). In some instances, continuous contact between the contact arm and the rebound bumpers results in creep deformation of the rebound bumpers or a fusing of the rebound bumpers to the contact arm thereby restricting movement of the contact arm from the OPEN to the CLOSED position.

Accordingly, there is a need in the art for a circuit breaker having improved contact control between stationary and moving components.

SUMMARY OF INVENTION

One embodiment of the present invention comprises a circuit breaker comprising a contact arm movable between a closed position, an open position and a blown open position wherein the contact arm is disposed in the circuit breaker. A bumper is disposed to contact the contact arm when the contact arm is in the blown open position. In addition, a stop member is disposed to be in contact with a linkage assembly so as to create a gap between the bumper and the contact arm when the contact arm is disposed in the open position.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
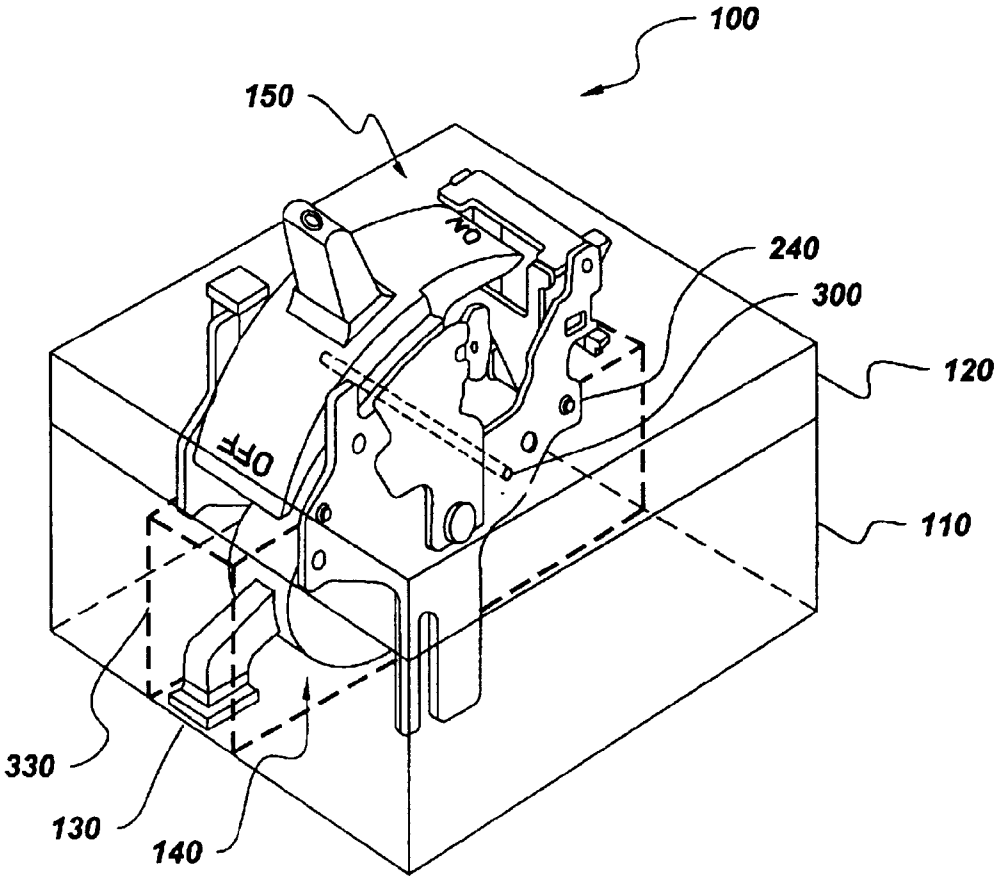
FIG. 1 is a top perspective view of a circuit breaker in accordance with one embodiment of the present invention.

Referring now to the drawings, FIG. 1 schematically shows a circuit breaker 100 comprising a base 110 and a cover 120. Enclosed within the base 110 and the cover 120 is a pole 130. In an alternative embodiment, the circuit breaker 100 comprises a plurality of poles and each of the plurality of poles corresponds to a respective phase in an electrical circuit. The pole 130 of FIG. 1 comprises a rotary contact assembly 140 wherein such rotary contact assembly 140 is capable of carrying and interrupting electrical current.

Figure 2:
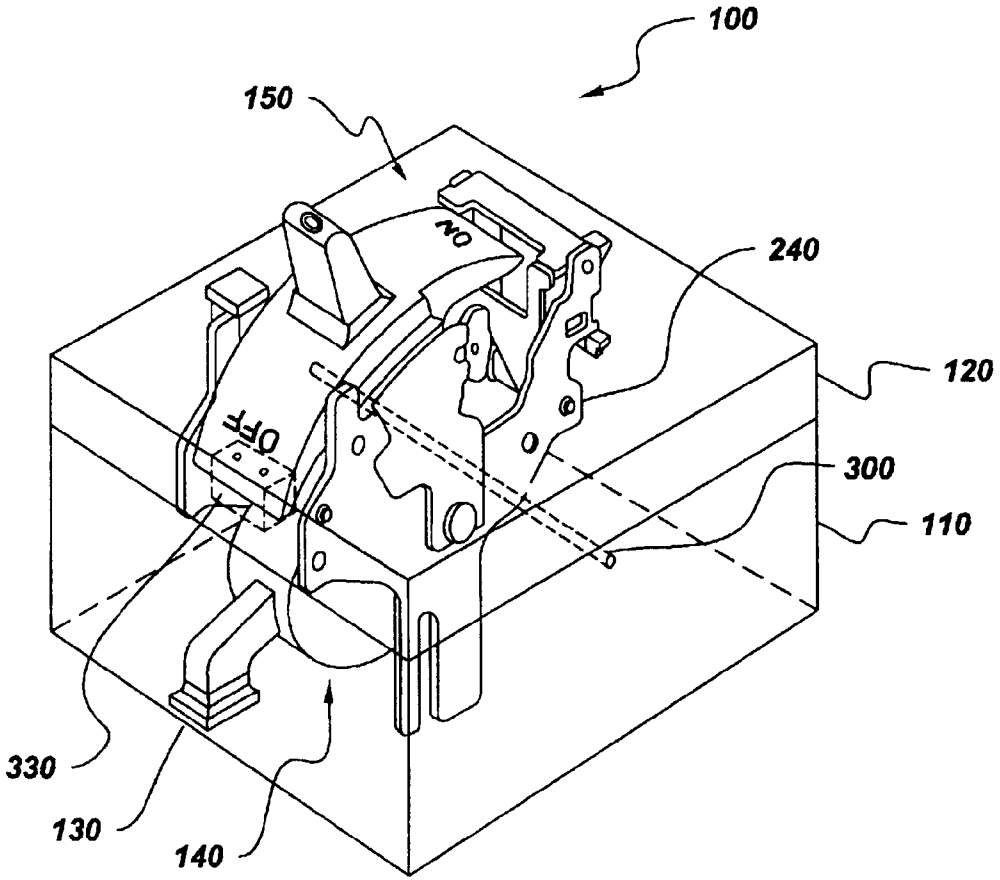
FIG. 2 is a top perspective view of a circuit breaker in accordance with another embodiment of the present invention.

FIG. 1 shows the pole 130 secured to a mechanism assembly 150. The mechanism assembly 150 comprises a (meaning at least one) side frame 240. The rotary contact assembly 140 is movable between an OPEN position (see FIG. 4) and a CLOSED position (see FIG. 5) in response to operation of the mechanism assembly 150. In addition the rotary contact assembly 140 is movable to a "BLOWN OPEN " position (see FIG. 6) in the event of a high current in the circuit breaker 100 (discussed below). The rotary contact assembly 140 of FIGS. 1 and 2 is typically secured to an electrically insulative cassette 330 (see FIG. 3). The term "electrically insulative", as used herein, refers to the material composition and geometry of cassette 330 wherein the material composition of the cassette 330 comprises electrically insulative material and the geometry of the cassette 330 is defined such that there is no electrical arcing between adjacent poles in the circuit breaker. In one embodiment, the electrically insulative cassette 330 is typically disposed in the base 110 of the circuit breaker 100 (see FIG. 1). As used herein, directional words such as, for example, "thereon", "therein", "on", "in", "over", "above", and "under" are used to refer to the relative location of elements of circuit breaker 100 as illustrated in the Figures and are not meant to be limitations in any manner with respect to the orientation or operation of circuit breaker 100.

Figure 4:
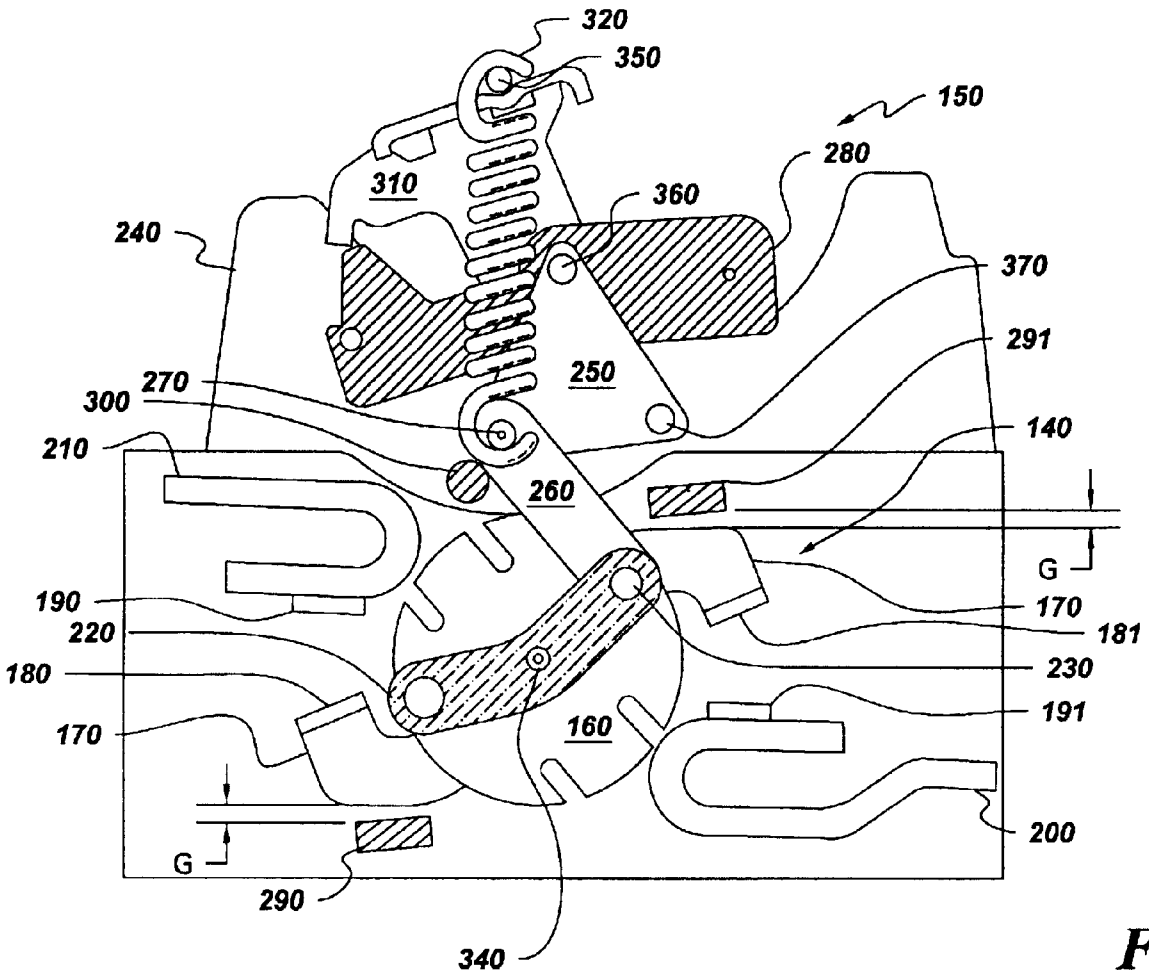
FIG. 4 is a front plan view of the rotary contact assembly of FIG. 3 wherein the rotary contact assembly is disposed in the CLOSED position.

Referring now to FIG. 4, the rotary contact assembly 140 comprises a rotor 160 which houses a movable contact arm 170 and a pair of movable contacts 180, 181 fixedly disposed on the ends of the movable contact arm 170. The movable contacts 180, 181 are in physical contact with a pair of stationary contacts 190, 191, respectively, when the mechanism assembly 150 is the CLOSED position (see FIG. 5). The stationary contacts 191, 190 are fixedly secured to a load strap 200 and a line strap 210 respectively. FIG. 4 shows the mechanism assembly 150 in the OPEN position. The "OPEN position", as used herein, refers to a position in which the movable contacts 180, 181 and the stationary contacts 190, 191 are not in physical contact with each other, thereby interrupting the flow of current to downline electrical devices. A crank member 220 connects the mechanism assembly 150 to the rotor 160 and pivots about a crank pivot pin 340.

Figure 5:
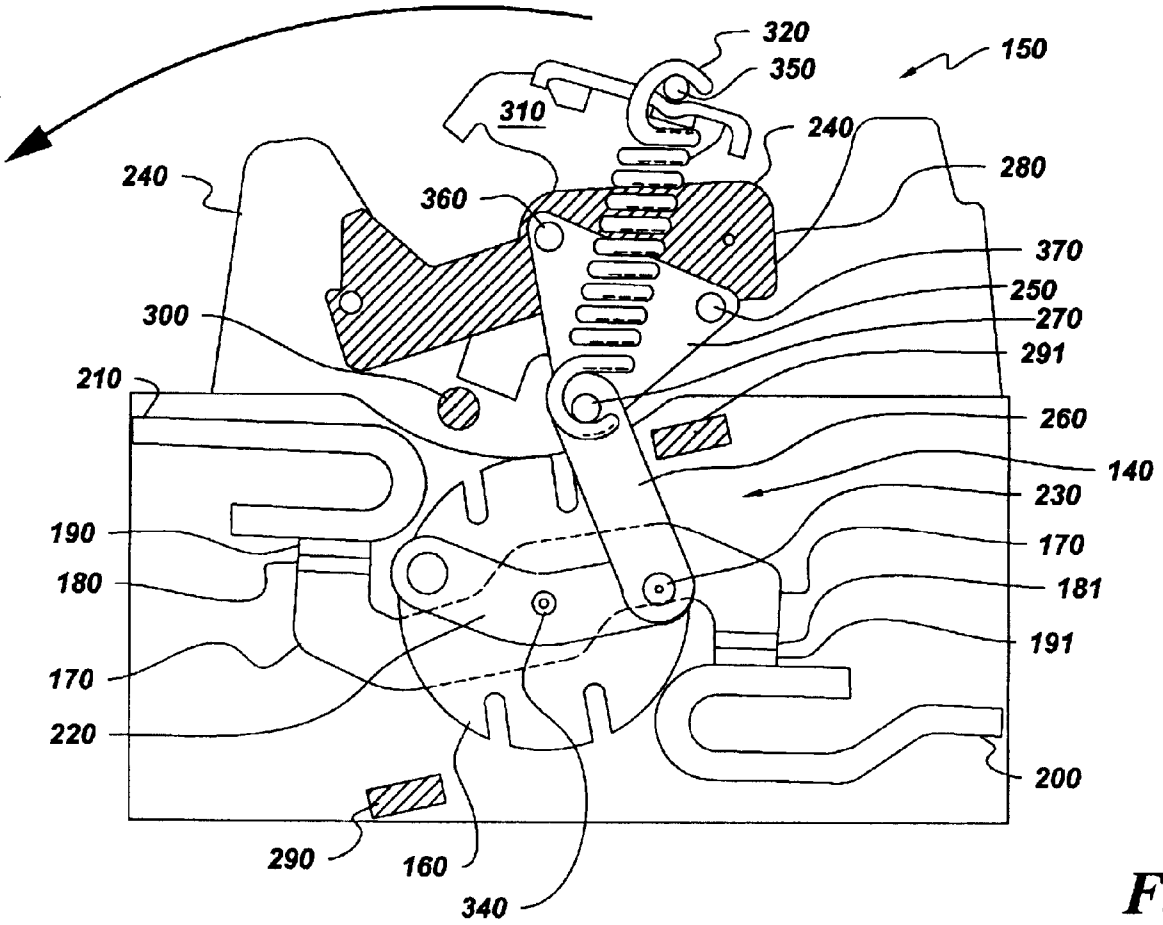
FIG. 5 is a front plan view of the rotary contact assembly of FIG. 3 wherein the rotary contact assembly is disposed in the OPEN position.
Figure 6:
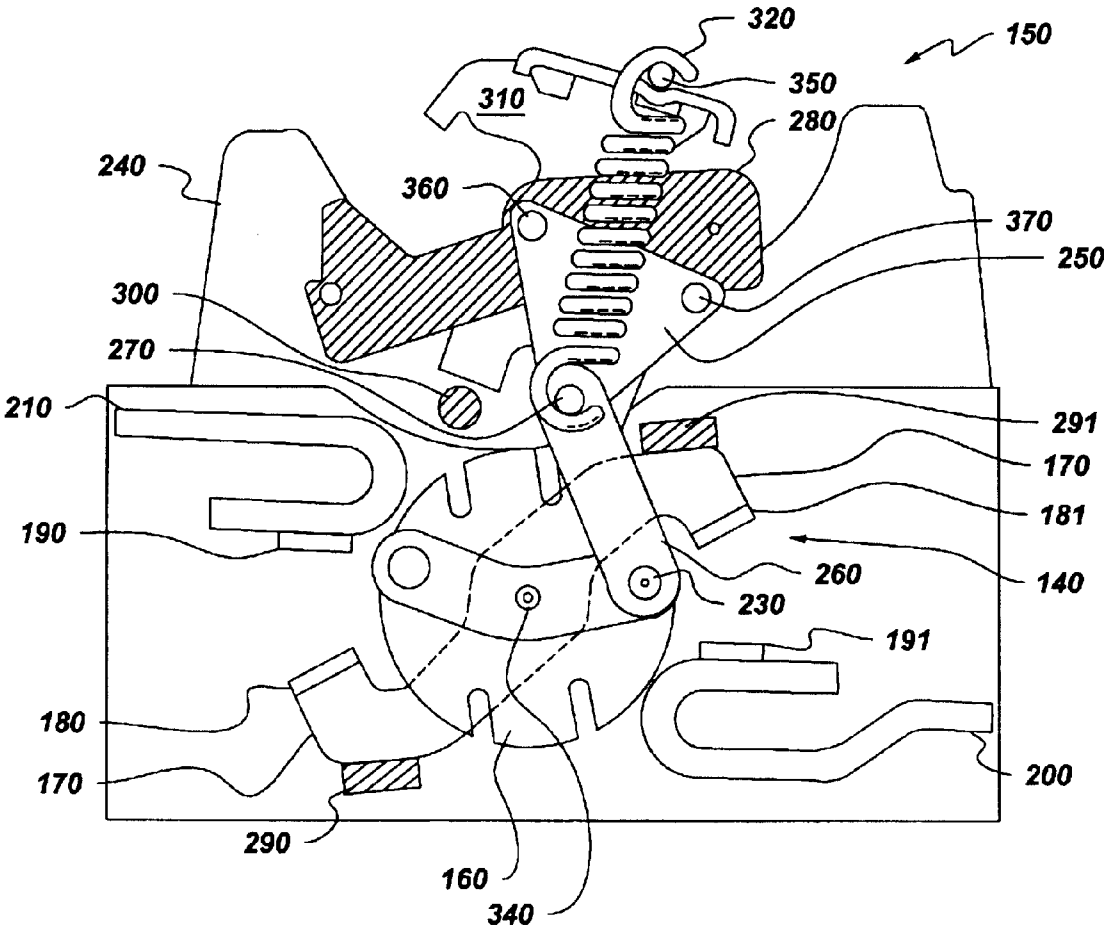
FIG. 6 is a front plan view of the rotary contact assembly of FIG. 3 wherein the rotary contact assembly is disposed in the BLOWN OPEN position.

Referring now to FIG. 5, the mechanism assembly 150 typically comprises a linkage assembly 245 defined by a lower link 260 and an upper link 250. The lower link 260 is secured to the crank member 220 by a connecting pin 230. The opposite end of the lower link 260 is secured to the upper link 250 by a spring spindle 270. The upper link 250 in turn is connected to a cradle 280 by an upper link pivot pin 360. A spring 320 is secured between the spring spindle 270 and a handle pin 350 wherein the handle pin 350 is disposed in a handle 310. By way of example and not limitation, the handle 310 is rotated counter-clockwise (shown by an arrow pointing from right to left of drawing FIG. 5) to switch the circuit breaker 100 from the on position (see FIG. 5) to the off position (see FIG. 4), or similarly, from the CLOSED position (see FIG. 5) to the OPEN position (see FIG. 4). As the handle 310 is rotated counter-clockwise (see FIG. 5), the line of action of the spring 320 will move from the right side to the left side of the upper link pivot pin 360 (see FIG. 4). Such counterclockwise movement causes the force stored in the spring 320 to separate the movable contacts 180, 181 from the stationary contacts 190, 191 thereby interrupting any flow of current through the circuit breaker 100.

Figure 3:
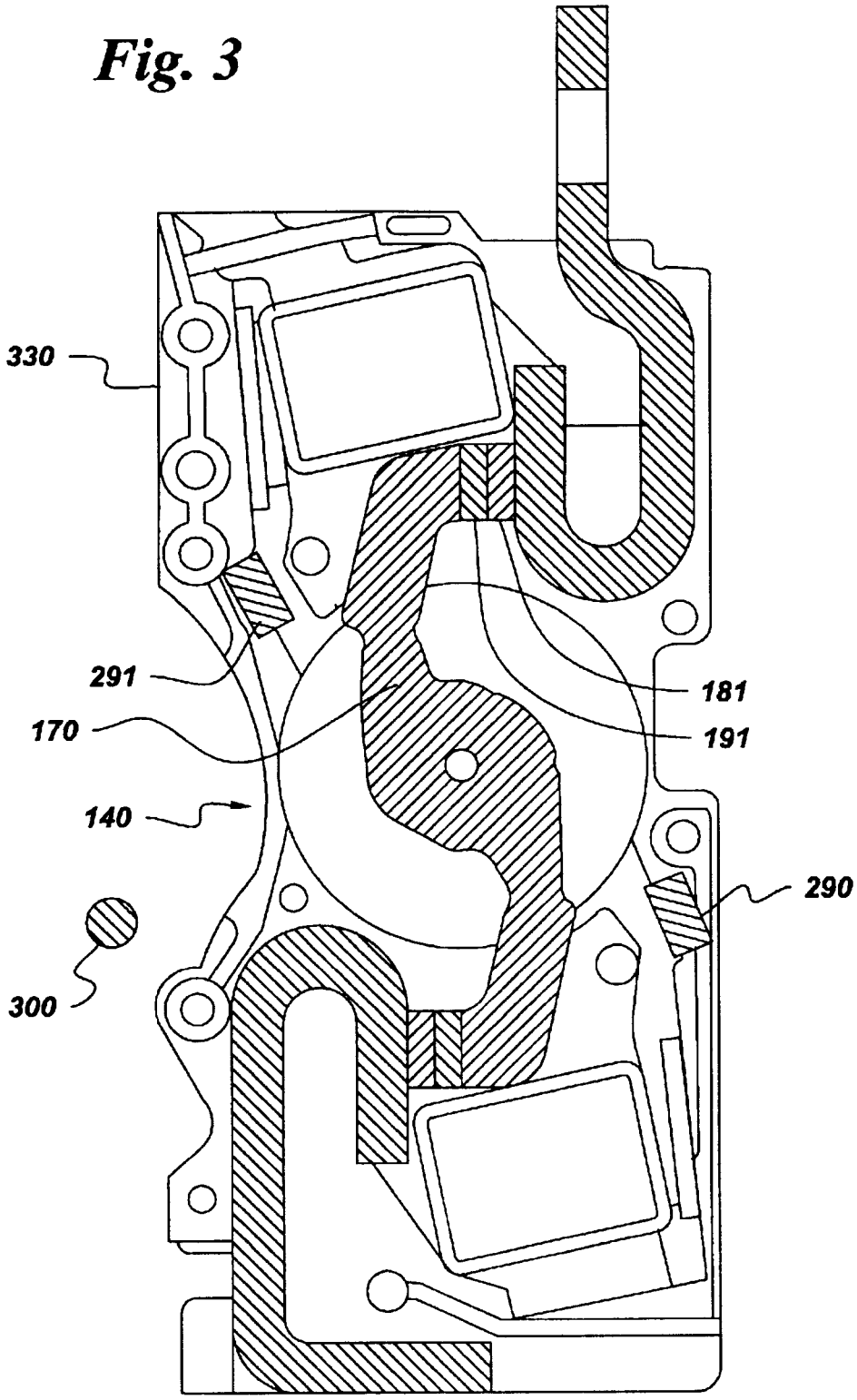
FIG. 3 is a cross-sectional view of an electrically insulative cassette having a rotary contact assembly disposed therein.

In one embodiment of the present invention (see FIG. 6), circuit breaker 100 comprises bumpers 290, 291 wherein the purpose of the bumpers 290, 291 are to dampen the impact force of the contact arm 170 when the contact arm 170 moves independently of the rotor 160 due to an introduction of a high current in the circuit breaker 100 (referred to as the BLOWN OPEN position). In an exemplary embodiment, such bumpers 290, 291 are secured to the electrically insulative cassette 330 as shown in FIG. 3. In an alternative embodiment, the bumpers 290, 291 are secured to the base 110 of circuit breaker 100 (see FIG. 2).

It is known in the art that traditional rotary contact circuit breakers are typically stored and shipped in a position where the contact arm 170 is in physical contact with rebound bumpers 290, 291 (Figure not shown). In one embodiment of the present invention and as shown in FIGS. 1 and 4, a (meaning at least one) stop member 300 is secured to the side frame 240. In an alternative embodiment, stop member 300 is secured to the base 110 of circuit breaker 100 (see FIG. 2). FIG. 4 shows the stop member 300 secured to the side frame 240 for making contact with the lower link 260 to provide a gap "G" between the bumpers 290, 291 and the contact arm 170. In an alternative embodiment, the stop member 300 is secured to the side frame 240 for making contact with the upper link 250 to provide the gap "G" between the bumpers 290, 291 and the contact arm 170 (not shown). In another embodiment, the stop member 300 is secured to the base of circuit breaker 100 (see FIG. 2) so as to make contact with the linkage assembly 245 (not shown).

Referring now to FIG. 4, the gap "G" between the contact arm 170 and the bumpers 290, 291 serves to prevent unwanted fusing between the contact arm 170 and the bumpers 290, 291. Such fusing typically occurs at temperatures where the bumper material begins to deform and "stick" to the contact arm 170. In addition, the gap "G" created by stop member 300 not only serves to physically isolate the contact arm 170 from the bumpers 290, 291, but also serves to prevent creep deformation of the bumpers 290, 291. The term "creep deformation," as used herein, refers to the change in shape of such bumpers 290, 291 due to the prolonged pressure on the bumpers 290, 291 caused by the contact arm 170 when circuit breaker 100 is shipped or stored in the position in which the contact arm 170 and the bumpers 290, 291 are in physical contact with one another. The location of stop member 300 may vary depending upon desired gap "G" size and such location as shown in the Figures is used for illustrative purposes. The stop member 300 is typically selected from the group consisting of pins, rods and the like.

It will be apparent to those skilled in the art that, while the invention has been illustrated and described herein in accordance with the patent statutes, modification and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A circuit breaker comprising:

a contact arm movable between a closed position, an open position and a blown open position, said contact arm disposed in said circuit breaker;

a bumper disposed to contact said contact arm when said contact arm is in said blown open position; and a stop member disposed to be in contact with a linkage assembly so as to create a gap between said bumper and said contact arm when said contact arm is disposed in said open position.

2. The circuit breaker of claim 1, wherein said bumper is secured to an electrically insulative cassette.

3. The circuit breaker of claim 2, wherein said stop member is secured to a side frame.

4. The circuit breaker of claim 2, wherein said stop member is secured to a base.

5. The circuit breaker of claim 1, wherein said bumper is secured to a base.

6. The circuit breaker of claim 5, wherein said stop member is secured to a side frame.

7. The circuit breaker of claim 5, wherein said stop member is secured to a base.

8. The circuit breaker of claim 1, wherein said stop member makes contact with a lower link of said linkage assembly when said contact arm is disposed in said open position.

9. The circuit breaker of claim 1, wherein said stop member makes contact with an upper link of said linkage assembly when said contact arm is disposed in said open position.

10. The circuit breaker of claim 1, wherein said stop member is selected from a group consisting of pins and rods.

11. A circuit breaker comprising:

a contact arm movable between a closed position, an open position and a blown open position, said contact arm disposed in said circuit breaker;

a bumper disposed to contact said contact arm when said contact arm is in said blown open position; and a stop member disposed to be in contact with a linkage assembly so as to create a gap between said bumper and said contact arm when said contact arm is disposed in said open position, said stop member secured to a side frame.

12. The circuit breaker of claim 11, wherein said bumper is secured to an electrically insulative cassette.

13. The circuit breaker of claim 11, wherein said stop member makes contact with a lower link of said linkage assembly when said contact arm is disposed in said open position.

14. The circuit breaker of claim 11, wherein said stop member makes contact with an upper link of said linkage assembly when said contact arm is disposed in said open position.

15. The circuit breaker of claim 11, wherein said stop member is selected from a group consisting of pins and rods.

* * * * *